US006877233B1

(12) United States Patent
Franke

(10) Patent No.: US 6,877,233 B1
(45) Date of Patent: Apr. 12, 2005

(54) CHAIN SAW ADJUSTER MECHANISM WITH LOCKING TEETH

(75) Inventor: Jeff S. Franke, Texarkana, TX (US)

(73) Assignee: Electrolux Home Products, Inc., Cleveland, OH (US)

( * ) Notice: Subject to any disclaimer, the term of this patent is extended or adjusted under 35 U.S.C. 154(b) by 0 days.

(21) Appl. No.: 10/753,619

(22) Filed: Jan. 8, 2004

(51) Int. Cl.[7] ..... B27B 17/02
(52) U.S. Cl. ..... 30/386; 30/383
(58) Field of Search ..... 30/381, 383, 386; 83/816

(56) References Cited

U.S. PATENT DOCUMENTS

| | | | | |
|---|---|---|---|---|
| 3,636,995 A | | 1/1972 | Newman | 30/386 |
| 4,129,943 A | | 12/1978 | Bricker | 30/386 |
| 4,315,370 A | | 2/1982 | Horne | 30/386 |
| 4,316,327 A | | 2/1982 | Scott et al. | 30/386 |
| 4,835,868 A | | 6/1989 | Nagashima | 30/386 |
| 4,920,650 A | * | 5/1990 | Edlund | 30/386 |
| 5,070,618 A | * | 12/1991 | Edlund | 30/386 |
| 5,144,751 A | | 9/1992 | Weber | 30/386 |
| 5,353,506 A | * | 10/1994 | Muller et al. | 30/386 |
| 5,491,899 A | | 2/1996 | Schliemann et al. | 30/386 |
| 5,522,143 A | | 6/1996 | Schliemann et al. | 30/386 |
| 5,896,670 A | | 4/1999 | Gibson et al. | 30/386 |
| 5,983,508 A | | 11/1999 | Sundstrom | 30/386 |
| 6,032,373 A | | 3/2000 | Peterson | 30/386 |
| 6,049,986 A | | 4/2000 | Calkins et al. | 30/386 |
| 6,061,915 A | | 5/2000 | Seigneur et al. | 30/386 |
| 6,237,228 B1 | * | 5/2001 | Moody | 30/381 |
| 6,237,229 B1 | | 5/2001 | Igawa et al. | 30/386 |
| 6,473,975 B1 | | 11/2002 | Sellmann | 30/386 |
| 6,493,949 B2 | | 12/2002 | Kondo et al. | 30/386 |
| 6,532,671 B1 | | 3/2003 | Jong | 30/386 |
| 6,560,879 B2 | | 5/2003 | Franke et al. | 30/386 |
| 6,564,459 B1 | | 5/2003 | Steinbrueck et al. | 30/383 |
| 6,782,627 B2 | * | 8/2004 | Hermes et al. | 30/386 |
| 2001/0042311 A1 | | 11/2001 | Kondo et al. | 30/386 |
| 2002/0012421 A1 | | 1/2002 | Geile et al. | |
| 2003/0024129 A1 | | 2/2003 | Franke et al. | 30/386 |

FOREIGN PATENT DOCUMENTS

DE 4436543 A1 5/1995

* cited by examiner

*Primary Examiner*—Hwei-Siu Payer
(74) *Attorney, Agent, or Firm*—Pearne & Gordon LLP

(57) ABSTRACT

A tensioning mechanism for adjusting tension of a cutting chain in a chain saw. A rotatable knob operates with an engine chassis, clutch cover, and guide bar, whereby the knob may be rotated between a tightened position and loosened position, by which the guide bar is loosened and may be adjusted. The knob is provided with a knob handle, pivotally connected to the knob and pivotable between locked and unlocked positions. When the knob handle is in the locked position, at least one, but not all, of a plurality of handle engagement points engage with corresponding fixed engagement points that are fixed relative to the clutch cover. When the knob handle is in the unlocked position, the handle engagement points are disengaged from the fixed engagement points. Further, the engagement points are visible when the knob handle is in both locked and unlocked positions.

6 Claims, 5 Drawing Sheets

CHAIN SAW ADJUSTER MECHANISM WITH LOCKING TEETH

FIELD OF THE INVENTION

The invention relates to an arrangement that facilitates periodic tensioning of an endless cutting chain on a guide bar of a chain saw.

BACKGROUND OF THE INVENTION

A cutting chain of a chain saw may become loose on a guide bar after some amount of use because of factors such as wear that results in elongation (i.e., stretch) of chain. Several saw constructions and associated methods exist to move the guide bar longitudinally away from a body and drive sprocket of the chain saw to take slack out of the cutting chain and ensure that links of the cutting chain remain snuggly seated in a peripheral channel in the guide bar.

A number of the constructions and associated methods require an operator to loosen a retaining assembly using one or more separate tools, to grasp and move the guide bar longitudinally from the chassis to increase cutting chain tension, and then to retighten the retaining assembly to retain the guide bar. In other constructions and associated methods, screws or hydraulic pistons integrated into the chain saw are employed to move the guide bar. For some of these other constructions, a retaining assembly is loosened and tightened accordingly. Further, the loosing and tightening may be accomplished via one or more separate tools. Another type of chain saw does not require the use of separate tools for loosing the retaining assembly, moving the guide bar, and tightening the assembly. However, continuing improvement is always desirable.

SUMMARY OF THE INVENTION

In accordance with one aspect, the present invention provides a tensioning mechanism for adjusting the tension of a cutting chain in a chain saw having an engine chassis, a clutch cover, and a guide bar. A rotatable knob operates with the engine chassis, the clutch cover, and the guide bar, whereby the knob may be rotated between a tightened position, in which the guide bar is tightened between the engine chassis and the clutch cover, and a loosened position, in which the guide bar is loosened and may be adjusted. The knob is provided with a knob handle, having an end portion pivotally connected to the knob, and a lock portion extending from the end portion, wherein the knob handle is pivotable between a locked position and an unlocked position. A plurality of fixed engagement points are provided and are fixed relative to the clutch cover, and a plurality of handle engagement points extend from the lock portion of the knob handle. When the knob handle is in the locked position, at least one of the handle engagement points is engaged with the corresponding fixed engagement points. When the knob handle is in the unlocked position, the handle engagement points are disengaged from the fixed engagement points. Further, the handle engagement points and the fixed engagement points are visible when the knob handle is in the locked position and when the knob handle is in the unlocked position.

In accordance with another aspect, the present invention provides a tensioning mechanism for adjusting the tension of a cutting chain in a chain saw having an engine chassis, a clutch cover, and a guide bar. A rotatable knob operates with the engine chassis, the clutch cover, and the guide bar, whereby the knob may be rotated between a tightened position, in which the guide bar is tightened between the engine chassis and the clutch cover, and a loosened position, in which the guide bar is loosened and may be adjusted. The knob is provided with a knob handle, having an end portion pivotally connected to the knob, and a lock portion extending from the end portion, wherein the knob handle is pivotable between a locked position and an unlocked position. A plurality of fixed engagement points are provided and are fixed relative to the clutch cover, and a plurality of handle engagement points extend from the lock portion of the knob handle. When the knob handle is in the locked position, at least one of the handle engagement points is engaged with the corresponding fixed engagement points, and the remaining handle engagement points are not engaged with the fixed engagement points. When the knob handle is in the unlocked position, the handle engagement points are disengaged from the fixed engagement points.

DESCRIPTION OF AN EXAMPLE EMBODIMENT

Figure 1:
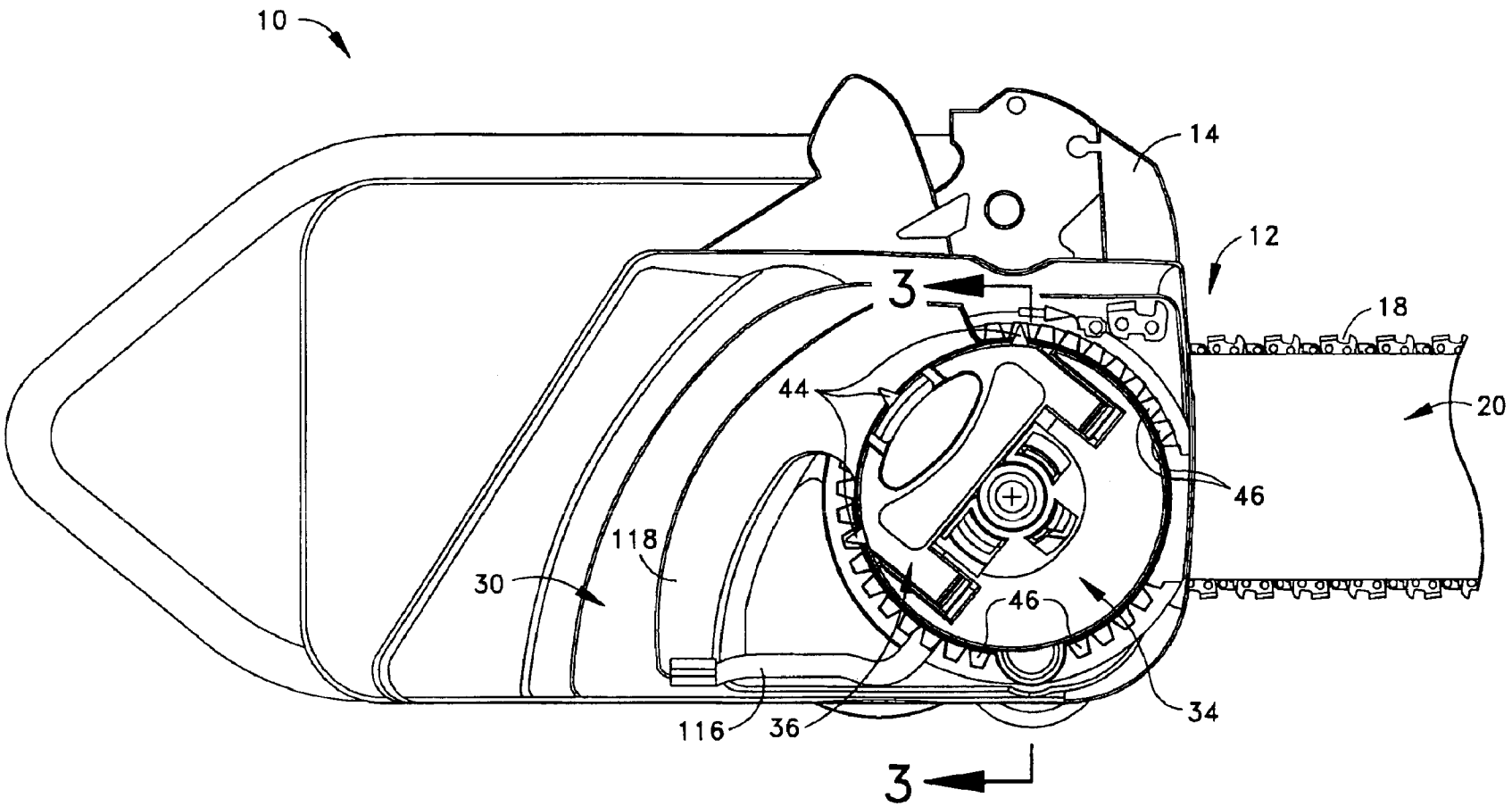
FIG. 1 is a side view of a portion of a chain saw that includes an example of a chain tensioning mechanism in accordance with the present invention.
Figure 2:
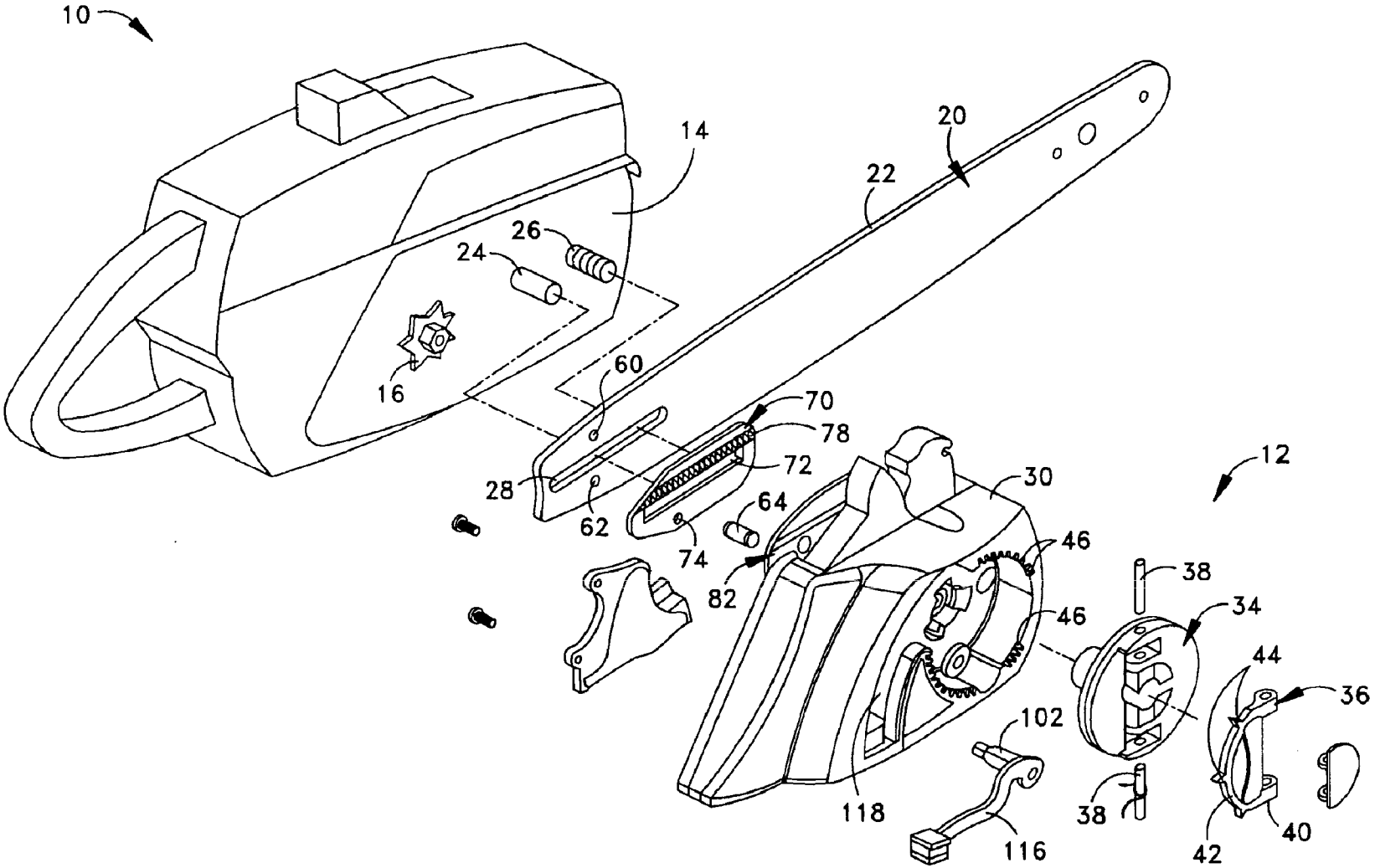
FIG. 2 is an exploded perspective view of the chain saw of FIG. 1.

FIGS. 1 and 2 illustrate a chain saw 10 that includes an example of a chain tensioning mechanism 12 in accordance with the present invention. The chain saw 10 has an engine chassis 14 and an engine (not shown) located on the chassis. As will be appreciated the engine turns a drive sprocket 16 (FIG. 2) attached to a drive shaft of the engine. The drive sprocket 16 engages the links of an endless cutting chain 18 (FIG. 1) and propels the chain around a guide bar 20.

The guide bar 20 is of an elongated plate configuration with a channel or groove 22 (FIG. 2) around its periphery and an idler sprocket (not shown) at its distal end into which the links of the cutting chain 18 ride. Parallel pins or studs 24 and 26 affixed to the engine chassis 14 lie in a common generally horizontal plane and extend perpendicularly through an elongated horizontal slot 28 in the guide bar 20 with a sliding fit. The studs 24 and 26, align the guide bar 20 to the engine chassis 14 and, since the spacing between the studs is considerably less than the length of the slot 28, the guide bar is able to slide horizontally on the studs for the purpose of chain adjustment as described below.

A clutch cover 30, of any suitable material, such as a molded plastic or a die case metal material, provides a housing for components that lock and unlock the movement of the guide bar 20 for purposes of adjustment of the cutting chain 18. The clutch cover 30 is removably attached to the forward stud 26 on the engine chassis 14. The forward stud 26 is externally threaded. Raised nodules or pins (not shown) may be provided on the inner facing of the clutch cover 30 to align with slots cut or otherwise made in the engine chassis 14 to position the clutch cover on the chassis.

Figure 3:
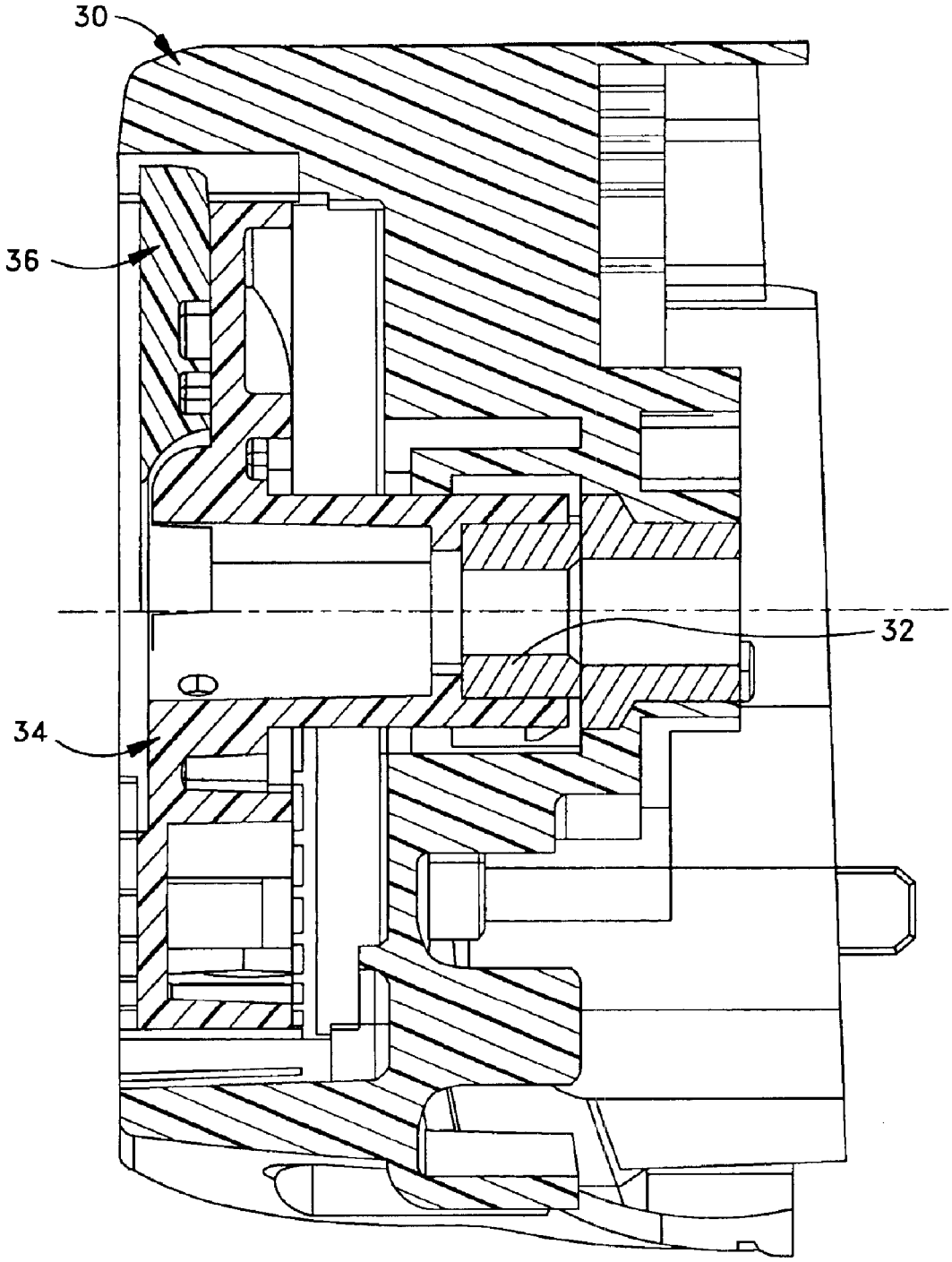
FIG. 3 is an enlarged cross-sectional view of taken along line 3—3 in FIG. 1, but with some parts removed.

In the shown example embodiment, a threaded knob insert 32 (FIG. 3) in a knob 34 is threaded onto the forward stud 26 (FIG. 2) to attach the clutch cover 30 to the engine chassis 14. The knob 34 and associated insert 32 are rotatable between a tightened position, where the guide bar 20 is held in a fixed position between the engine chassis 14 and the clutch cover 30, and a loosened position, where the guide bar is permitted to move longitudinally (e.g., for an adjustment movement that tightens the cutting chain 18).

Figure 4:
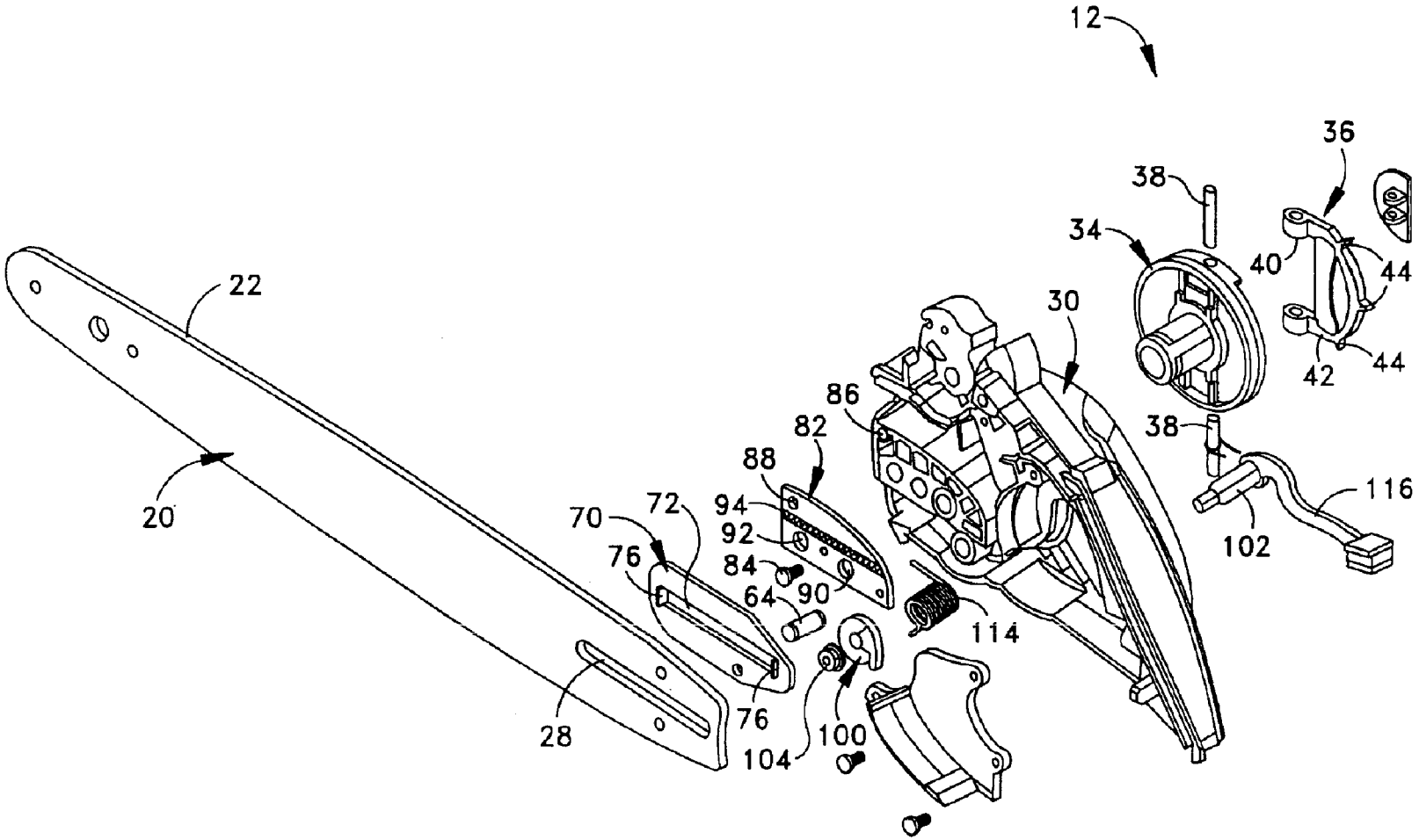
FIG. 4 is an exploded perspective view of some of the chain saw parts from a side opposite that of FIG. 2.

A knob handle 36 is pivotally mounted on the knob 34 via pins 38. The pins 38 extend from two sides of an end 40 of the knob handle 36. The knob handle 36 is pivotable from a locked position (shown in FIG. 1), in which the entire knob handle is in close proximity to the knob 34, to an unlocked position, in which a graspable lock portion of the knob handle is located away from the knob. With the knob handle 36 in the unlocked position, the knob handle can be easily grasped and the knob 34 can be caused to rotate (i.e., between the tightened and loosened positions) without the use of additional tools. A small spring may be provided to bias the knob handle 36 toward the lock position. For example, FIGS. 2 and 4 show a small spring on one of the pins 38. Also, a cover tab (See FIGS. 2 and 4) may also be provided at the knob handle 36.

The segment of the knob handle 36 that is grasped is a part of the handle that is referred to herein as a lock portion 42. A plurality of engagement points 44 are located on the lock portion 42. Within the shown example, the engagement points 44 are rigid, extending protrusions or teeth. The engagement points 44 are at a radially outer periphery of the knob handle 36 with respect to a rotational axis of the knob 34. Further, within the shown example, the protrusions or teeth extend radially outward from the rotational axis of the knob 34.

The clutch cover 30 (FIG. 2) is provided with a series of fixed engagement points 46 that can interact with the engagement points 44 on the knob handle 36. In the shown example, the engagement points 46 are notches in a periphery of a recessed portion of the clutch cover 30. It is to be appreciated that the engagement points 44 on the knob handle 36 and the engagement points 46 on the clutch cover 30 may have different shapes, configurations, etc. than as shown in the present example. For example, the fixed engagement points 46 on the clutch cover 30 may be in the recessed portion (e.g., in the distal surface of the recessed portion), with the engagement points 44 on the knob handle 36 extending (e.g., parallel to the knob rotational axis) toward the fixed engagement points.

When the knob handle 36 is in the locked position (shown in FIG. 1), at least one of the handle engagement points 44 is engaged with one of the engagement points 46, thereby securing the knob 34 in a fixed position, preventing inadvertent adjustment of the knob resulting from bumps or vibrations. When the knob handle 36 is pivoted to the unlocked position, the handle engagement points 44 disengage from the fixed engagement points 46, allowing the knob 34 to be rotated relative to the clutch cover 30. It is contemplated that a sufficient number of engagement points 44 and 46 may be provided so that the knob 34 and knob handle 36 may be locked into any rotational position with a minimum amount of rotation repositioning prior to locking of the knob handle. It is to be appreciated that the arrangement of the fixed engagement points 46 on the clutch cover 30 may be discontinuous, allowing for gaps between groups of fixed engagement points 46, as shown within the example of FIGS. 1 and 2. Such grouping of fixed engagement points 46 may be useful to allow accommodation or clearance for other chain saw components, sufficient wall thickness, etc.

The quantity and position of the engagement points 44 on the knob handle 36 may be arranged such that, in the locked position, only some of the handle engagement points are engaged with corresponding fixed engagement points 46 while the remaining handle engagement points are not so engaged. The quantity and position are such that at least some of the handle engagement point 44 engage for each position of the knob handle 36. It is contemplated that multiple handle engagement points 44 are engaged with corresponding fixed engagement points 46.

The present shown example is configured such that the handle engagement points 44 and fixed engagement points 46 are visible whether the knob handle 36 is in the locked position or in the unlocked position. In particular, the visibility of the engagement points 44 and 46 can provide the operator with a visual indication. Such an indication can be useful when aligning the engagement points 44 and 46 for engagement. The visual indication may also be useful as an indicator that the engagement points 44 and 46 are engaged.

Turning back to the aspect of moving the guide bar 20, it is to be appreciated that the aspects of the engagement points 44 and 46 may be utilized with various constructions, configuration, etc. associated with the movement of the guide bar. The present illustrated embodiment has structures associated with the aspect of moving the guide bar 20; however, the structures merely provide one example.

The elongated horizontal slot 28 (FIG. 2) in the guide bar 20 allows the guide bar to be moved away from the drive sprocket 16 along the horizontal axis defined by the location of the studs 24 and 26. This movement of the guide bar 20 takes up slack in the cutting chain. The guide bar 20 has a hole 60 located above the horizontal slot 28 that allows oil from an oiler (not shown) on the engine chassis 14 to provide lubrication to the guide bar and cutting chain 18 when the chain saw 10 is in operation. Located below the slot 28 is a second hole 62 into which a cylindrical tensioner pin 64, extending perpendicularly from the plane of the guide bar 20, is pressed or otherwise fixed, preferably permanently. In the shown example, the tensioner pin 64 projects beyond the guide bar 20 by a distance at least equal to the thickness of the guide bar and preferably about at least twice the thickness of the guide bar.

To secure the guide bar 20 in a fixed position when the knob 34 is in the tightened position, the chain saw may utilize a locking plate 70 that has a slot 72 coinciding with the slot 28 in the guide bar 20 and a hole 74 aligned over the tensioner pin 64 located on the guide bar 20 (at a side from which the tensioner pin principally projects). The shown example of the locking plate 70 has tabs 76 folded through the slot 28. An elongated high friction surface 78 may be provided above the slot 72 on the side of the locking plate 70 facing towards the clutch cover 30. The friction surface 78 may be a series of relatively small vertical ridges of triangular cross-section coined into the plate 70.

In the shown example, a cover plate 82 (FIG. 4), secured to the clutch cover 30 by a machine screw 84, is positioned to overlie the locking plate 70 via at least one molded locator pin 86 that extends into a respective locator hole 88 in the cover plate. Holes 90 and 92 in the cover plate 82 are aligned with and assembled over the studs 24 and 26 on the engine chassis 14 to fix the cover plate relative to the chassis. An elongated high friction surface 94 may be formed on the cover plate 82, and the friction surface 94 is aligning with the friction surface 78 on the locking plate 70.

Figure 5:
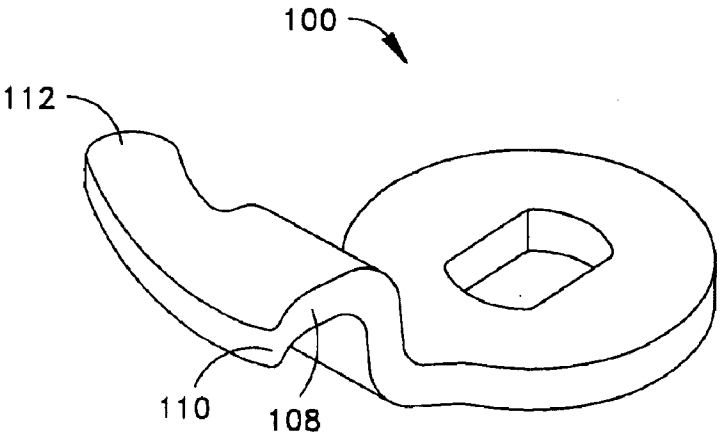
FIG. 5 is an enlarged perspective view of a chain tensioner cam used in one embodiment of the invention.

In the shown example, a specially designed cam 100 (FIG. 4) is attached to a pivot pin 102 by a hex-flange locking nut 104 such that the cam is rotationally locked to the pivot pin. The cam 100 (FIG. 5) has a working edge surface 108, a rise area 110 at a radially outer periphery of the working edge surface, and a trailing section 112. The cam 100 is continuously biased against the tensioner pin 64 (see FIGS. 6A–6C) by a torsion spring 114 (FIG. 4). The spring 114 is located in a cavity in the clutch cover 30.

The pivot pin 102 extends through the clutch cover 30 and is associated with an override lever 116, which is operable for manual adjustment of the position of the guide bar 20. In one example, the override lever 116 may be staked or otherwise rigidly attached to an outer end of the pivot pin 102 and located in a molded override channel 118 on the external face of the clutch cover 30. The override lever 116 is arranged to directly follow the angular movement of the cam 100 as the cam biases the tensioner pin 64 forcing the guide bar 20 outward to tension the cutting chain 18. Nomenclature, embossed or otherwise attached along the side of the override channel, to which the free end of the override lever 116 points, can indicate to the operator when the cutting chain 18 should be replaced. It will be seen that the clutch cover 30 supports the cover plate 82, the cam 100, the pivot pin 102, the lever 116, and the knob 34. It is to be appreciated that other structure is present at the clutch cover (e.g., see FIGS. 2 and 4). It is to be appreciated that such other structure is not a limitation on the present invention.

When the knob 34 is rotated to the tightened position, it tightens the friction surface 94 on the cover plate 82 against the friction surface 78 on the locking plate 70. When these two surfaces are forced together, the tensioner pin 64 is locked against movement, and thus the guide bar 20 is kept in its present position. When the knob 34 is rotated to the loosened position to release the pressure of the friction surfaces, the spring-biased cam 100 forces the guide bar 20 forward to tension the cutting chain 18. When the knob 34 is fully turned beyond the loosened position, the clutch cover 30 can be removed from the engine chassis 14. Usually this is done only to replace an endless cutting chain 18. When the clutch cover 30 is removed from the engine chassis 14, the cam 100 is released from the tensioner pin 64 and springs to its most extended position. A trailing section 112 (FIG. 5) of the cam 100 overlies the end of the tensioner pin 64 on the guide bar 20 if the cam is not first angularly retracted by manually moving the override lever 116 counter-clockwise against the force of the spring 114 and thereby prevents installation of the clutch cover 30 until the cam 100 is on the proper rearward side of the tensioner pin 64. When the clutch cover 30 is again assembled onto the engine chassis 14, and the override lever 116 is released, the spring-biased cam 100 again biases the tensioner pin 64 moving the guide bar 20 to its fully tensioned position.

In use, the operator ensures that the knob 34 is fully turned clockwise (as viewed in FIG. 1, and the clutch cover assembly 12 is tightened onto the engine chassis 14. As the chain saw 10 is used over a period of time the length of the cutting chain 18 may increase (e.g., the links of the cutting chain may wear at their pin joints). When the operator observes excessive slack in the cutting chain 18, he or she raises the knob handle 36, disengaging the handle engagement points 44 from the fixed engagement points 46, and turns the knob 34 to the loosened position, backing the clutch cover 30 slightly off of the engine chassis 14. With this action, the friction surface 94 on the cover plate 82 is released from the friction surface 78 on the locking plate 70. The spring 114 biases the working edge surface 108 of the cam 100 against the tensioner pin 64, forcing the guide bar 20 away from the drive sprocket 16 to tension the cutting chain 18. The location of the tensioner pin 64 beneath the studs 24 and 26 enables the force applied by the cam 100 to assist in overcoming the moment developed by the overhanging weight of the guide bar 20 and cutting chain 18 to assist in smooth tensioning movement.

The override lever 116, directly attached to the spring-biased cam 100, moves upward in the override channel 118 to a new position. The override lever 116 can be manually pushed to assist the spring 114. The indicia associated with the override lever 116 and the override channel 118 indicates the cutting chain extension. For example, the indicia may include an indicia legend, such as "REPLACE CHAIN" to indicate when the chain has elongated to the point of being in need of replacement. Such an arrangement is shown within U.S. Pat. No. 6,560,879, the entire disclosure of which is incorporated herein by reference.

Figure 6B:
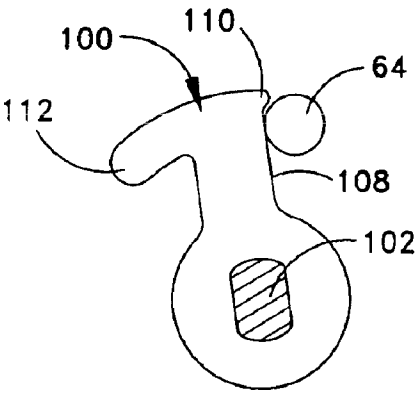
FIGS. 6A, 6B, and 6C are a progressive series of positions, each an enlarged view, of the cam as it bears against a tensioner pin as a cutting chain becomes elongated.
Figure 6C:
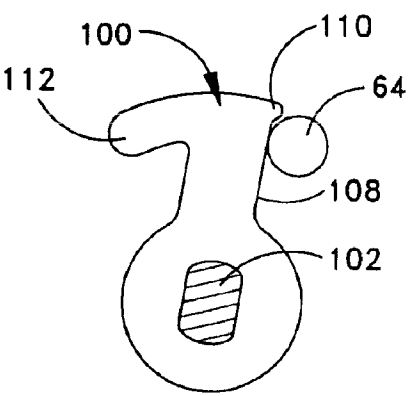
Figure 6A:
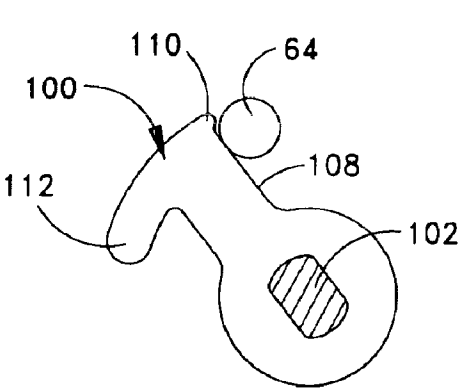

FIGS. 6A–6C illustrate successive positions of the cam 100 as the cutting chain experiences wear. FIG. 6A represents the position of the cam 100 when the cutting chain 18 is, for example, new. FIG. 6B shows the cam 100 in a mid-position, and FIG. 6C shows the cam in a position where the cutting chain has reached the end of its useful life.

Once the guide bar 20 has adjusted and the cutting chain 18 has tightened, the knob 34 is rotated back to the tightened position, and the knob handle 36 is returned to the locked position, with at least one of the handle engagement points 44 engaging with the corresponding fixed engagement points 46, thereby securing the knob in the tightened position.

The present invention can provide various advantages. For example, the present invention can provide improved ease of movement of the guide bar. Also, the present invention can enable an operator to make such adjustments without additional tools, and it will allow for a lower tightening torque of the tensioning mechanism with a visible, locked-in tightened position.

The present invention can be used with various other constructions, configurations, etc. For example, it is to be noted that the present invention can be employed with an automatic tension adjustment mechanism.

Also, it is to be noted that the present invention can have various other features. For example, the present invention can provide an indication to the chain saw operator when the chain should be replaced.

From the above description of the invention, those skilled in the art will perceive improvements, changes and modifications in the invention. Such improvements, changes and modifications are intended to be covered by the appended claims.

What is claimed is:

1. A tensioning mechanism for adjusting tension of a saw chain in a chain saw having an engine chassis, a clutch cover, and a guide bar, the mechanism comprising:

a rotatable knob operatively cooperative with the engine chassis, the clutch cover, and the guide bar, wherein the knob can be rotated between a tightened position, in which the guide bar is tightened between the engine chassis and the clutch cover, and a loosened position, in which the guide bar is loosened and may be adjusted;

a knob handle, having an end portion pivotally connected to the knob, and a lock portion extending from the end portion, wherein the knob handle is pivotable between a locked position and an unlocked position;

a plurality of fixed engagement points fixed relative to the clutch cover; and a plurality of handle engagement points extending from the lock portion of the knob handle, wherein at least one of the handle engagement points engages with respective fixed engagement points when the knob handle is in the locked position, and the handle engagement points are disengaged from the fixed engagement points when the knob handle is in the unlocked position, and the handle engagement points and the fixed engagement points are visible when the knob handle is in the locked position and when the knob handle is in the unlocked position.

2. A tensioning mechanism as set forth in claim 1, wherein the handle engagement points extend radially with respect to a rotational axis of the knob.

3. A tensioning mechanism as set forth in claim 1, wherein the handle engagement points are at a radially outer periphery of the knob handle with respect to a rotational axis of the knob.

4. A tensioning mechanism as set forth in claim 1, wherein at least one of the handle engagement points engages with respective fixed engagement points and the remaining handle engagement points are not engaged with the fixed engagement points when the knob handle is in the locked position.

5. A tensioning mechanism for adjusting tension of a saw chain in a chain saw having an engine chassis, a clutch cover, and a guide bar, the mechanism comprising:

a rotatable knob operatively cooperative with the engine chassis, the clutch cover, and the guide bar, wherein the knob can be rotated between a tightened position, in which the guide bar is tightened between the engine chassis and the clutch cover, and a loosened position, in which the guide bar is loosened and may be adjusted;

a knob handle, having an end portion pivotally connected to the knob, and a lock portion extending from the end portion, wherein the knob handle is pivotable between a locked position and an unlocked position;

a plurality of fixed engagement points fixed relative to the clutch cover; and a plurality of handle engagement points extending from the lock portion of the knob handle, wherein at least one of the handle engagement points engages with respective fixed engagement points and the remaining handle engagement points are not engaged with the fixed engagement points when the knob handle is in the locked position, and the handle engagement points are disengaged from the fixed engagement points when the knob handle is in the unlocked position.

6. A tensioning mechanism as set forth in claim 5, wherein the handle engagement points and the fixed engagement points are visible when the knob handle is in the locked position and when the knob handle is in the unlocked position.

* * * * *